US006395104B1

(12) United States Patent
Kosuge et al.

(10) Patent No.: US 6,395,104 B1
(45) Date of Patent: May 28, 2002

(54) METHOD OF PRODUCING UNIDIRECTIONAL ELECTROMAGNETIC STEEL SHEET HAVING EXCELLENT FILM CHARACTERISTICS AND MAGNETIC CHARACTERISTICS

(75) Inventors: Kenji Kosuge; Kishio Mochinaga; Eiichi Nanba; Nobuo Tachibana; Shinya Ishii; Naoki Yagi, all of Himeji (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/202,511

(22) PCT Filed: Jan. 9, 1998

(86) PCT No.: PCT/JP98/00052

§ 371 (c)(1),
(2), (4) Date: Dec. 15, 1998

(87) PCT Pub. No.: WO98/46803

PCT Pub. Date: Oct. 22, 1998

(30) Foreign Application Priority Data

Apr. 16, 1997 (JP) ..... 9-099323
Aug. 18, 1997 (JP) ..... 9-221826

(51) Int. Cl.[7] ..... C21D 1/76; C21D 6/00
(52) U.S. Cl. ..... 148/113
(58) Field of Search ..... 266/104, 111, 266/103; 148/111, 113, 307, 308

(56) References Cited

U.S. PATENT DOCUMENTS 3,964,989 A * 6/1976 Ackerly et al. ..... 204/211
3,997,317 A * 12/1976 Dicks ..... 65/350
4,268,326 A * 5/1981 Iwayama et al. ..... 148/113
4,579,608 A * 4/1986 Shimizu et al.
4,898,627 A * 2/1990 Schoen ..... 148/111
5,472,520 A * 12/1995 Anabuki et al. ..... 148/216
5,484,484 A * 1/1996 Yamaga et al.
5,565,272 A * 10/1996 Masui et al. ..... 428/432
5,620,533 A * 4/1997 Kotani et al.
5,833,768 A * 11/1998 Kosuge et al.

FOREIGN PATENT DOCUMENTS

| | | | |
|---|---|---|---|
| JP | 57-1575 | | 1/1982 |
| JP | 1-290716 | | 11/1989 |
| JP | 4-202713 | | 7/1992 |
| JP | 05078736 A | * | 3/1993 |
| JP | 7-62436 | | 3/1995 |
| JP | 09059723 A | * | 3/1997 |

OTHER PUBLICATIONS

Merriam–Webster's Collegiate Dictionary, 1997, Merriam–Webster, Inc. Tenth Edition, p. 1229.*

* cited by examiner

*Primary Examiner*—Roy King
*Assistant Examiner*—Harry D. Wilkins, III
(74) *Attorney, Agent, or Firm*—Kenyon & Kenyon

(57) ABSTRACT

A process for producing a grain-oriented electrical steel sheet wherein during the decarburization annealing step, the steel sheet is first rapidly heated in a rapid heating chamber and the $PH_2O/PH_2$ ratio in the rapid heating chamber is more than the $PH_2O/PH_2$ ratio in the decarburization annealing furnace so as to provide improved oxide film adhesion.

5 Claims, 7 Drawing Sheets

△ : Si/Al PEAK POSITION RATIO (D/C) ≤ 0.01
◆ : Si/Al PEAK POSITION RATIO (D/C) > 0.01, ≤ 0.1

METHOD OF PRODUCING UNIDIRECTIONAL ELECTROMAGNETIC STEEL SHEET HAVING EXCELLENT FILM CHARACTERISTICS AND MAGNETIC CHARACTERISTICS

FIELD OF THE INVENTION

The present invention provides a grain-oriented electrical steel sheet containing from 2.0 to 7.0% of Si and excellent in film characteristic and iron loss characteristics. Moreover, the present invention provides a process for producing a grain-oriented electrical steel sheet extremely excellent in film characteristics and excellent in iron loss characteristics by controlling the initial oxide film of a steel strip which has been rapidly heated in the heating stage for decarburization annealing prior to introducing the steel strip into the decarburization annealing furnace. Furthermore, the present invention provides a decarburization annealing facility used in the production process. The present invention relates to the products, the production process and the facility.

BACKGROUND OF THE INVENTION

The magnetic characteristics of grain-oriented electrical steel sheets are generally evaluated for both iron loss and excitation characteristics. Improving the excitation characteristics is effective in downsizing an apparatus of which the designed magnetic flux density is to be increased. On the other hand, decreasing the iron loss is effective in reducing the energy lost as thermal energy and saving power consumption during the use of the steel sheet in electrical appliances. Moreover, aligning the <100> orientation of the grains of the product improves the excitation characteristics and lowers the iron loss. Many investigations have been carried out in this field in recent years, and various products and production technologies have been developed.

For example, Kokoku (Japanese Examined Patent Publication) No. 40-15644 discloses a process for producing a grain-oriented electrical steel sheet for obtaining a high magnetic flux density. In the process, AlN+Mng functions as an inhibitor, and the steel sheet is forcibly rolled with a reduction ratio exceeding 80% in the final cold rolling step. According to the process, the density of the {110}<001> orientation of the secondary recrystallization is high, and a grain-oriented electrical steel sheet having a high magnetic flux density of at least 1.870 T in terms of $B_8$ can be obtained.

However, although the iron loss can be decreased to some extent by the production process, the macroscopic grain diameter of secondary recrystallized grains is of the order as large as 10 mm. As a result, the eddy-current loss which is a factor influencing the iron loss cannot be decreased, and a superior iron loss has not been obtained.

In contrast to the process mentioned above, Kokoku (Japanese Examined Patent Publication) No. 6-51187 discloses a process for making secondary recrystallized grains smaller to improve the magnetic characteristics. The process comprises ultrarapidly annealing a steel sheet (strip) which has been rolled at an ambient temperature at temperatures of at least 657° C. at a heating rate of at least 140° C./sec, decarburizing the steel sheet, and final annealing the steel sheet at high temperatures so that secondary grain growth takes place, whereby the steel sheet contains secondary grains having a decreased size and has a lasting improved iron loss without a significant change even after stress relieving annealing.

However, it is difficult to obtain an electrical steel sheet exhibiting an iron loss comparable to that of an electromagnetic steel sheet having fine magnetic domains, by merely converting the secondary grains into fine ones by the production process. In particular, in final annealing where the steel sheet is rapidly exposed to high temperatures by rapid heating to form an oxide film having a different composition and to preferentially form fayalite ($Fe_2SiO_4$), coating the steel sheet with MgO does not necessarily result in an excellent formation of forsterite ($2MgO \cdot SiO_2$). As a result, there arises the problem that excellent magnetic characteristics cannot be obtained due to an insufficient film tension.

In order to solve such a problem, Kokai (Japanese Unexamined Patent Publication) No. 7-62436 proposes the following method: directly before annealing a steel strip having been rolled to a final sheet thickness or in a heating stage of decarburization annealing, the steel strip is heated to at least 700° C. at a heating rate of at least 100° C./sec in a nonoxidizing atmosphere having a $PH_2O/PH_2$ ratio of up to 0.2, and heat treated. Moreover, the patent publication also proposes the use of two pairs of conductor rolls as a concrete example of rapid heating.

However, it has been found that a dense oxide layer is sometimes formed on the steel sheet during rapid heating in such a production method. When such an oxide layer is formed, it becomes a barrier, and influences the decarburization. In particular, decarburization of a magnetic steel sheet having a residual C content of up to 40 ppm becomes difficult. As a result, the magnetic characteristics of the products are deteriorated due to magnetic aging, although an electrical steel sheet having excellent magnetic characteristics can be obtained immediately after the production. Moreover, it becomes impossible to sufficiently decarburize the steel sheet to have a residual C content of up to 20 ppm even by extending the decarburization time.

Furthermore, a grain-oriented electrical steel sheet is generally bent when wound cores are prepared therefrom and incorporated into transformers, etc. Accordingly, the electrical steel sheet is required to have such an excellent film adhesion, particularly at the corner portions having a large curvature, that no peeling of them surface film consisting of a primary film and a secondary film (insulating coating) takes place. In the production process mentioned above, there is still room for improving the film adhesion.

DISCLOSURE OF THE INVENTION

The present invention provides a grain-oriented electrical steel sheet containing from 2.0 to 7.0% of Si and excellent in film characteristics (film adhesion) and magnetic characteristics (iron loss characteristics), a process for producing the same, and a decarburization annealing facility used for the production process.

In order to obtain a grain-oriented electrical steel sheet excellent in both the film characteristics (film adhesion) and the magnetic characteristics (iron loss characteristics), the present inventors carried out many tests wherein a steel strip rolled to have a final product thickness was rapidly heated to at least 800° C. at a heating rate of at least 100° C./sec in the heating stage in the decarburization step.

The tests were carried out using a decarburization annealing facility prepared by altering a conventional decarburization annealing furnace which had already been installed and was generally used for practicing a decarburization annealing step and which had, on the steel strip entry side (usually within 5 m from the steel strip inlet), an exhaust vent to the atmosphere.

That is, the tests were carried out using a decarburization annealing facility, wherein a rapid heating chamber provided with an apparatus for conducting the rapid heating was connectively provided to the entry side of a decarburization annealing furnace having already been installed with or without a throat portion provided between the furnace and the chamber, and the atmosphere of the rapid heating chamber and that of the decarburization annealing furnace were exhausted through the exhaust vent mentioned above.

During conducting the decarburization annealing step using the decarburization annealing facility, investigations were made on the relationships between an atmosphere of the rapid heating chamber (including the throat portion when provided), an atmosphere of the decarburization annealing furnace, a residence time of the steel strip at temperatures of at least 750° C. in the rapid heating chamber (including the throat portion when provided), a film adhesion of the product and iron loss characteristics prior to and subsequent to magnetic aging. As a result, the following discoveries have been made.

1) A product excellent in characteristics shows that the peak position of Si is up to 1/10 of the peak position of Al therefrom on the surface layer side when subjected to glow discharge spectral analysis (GDS analysis).
2) A product still more excellent in both characteristics shows that the peak position of Si from the oxide film surface is up to 1/20 of the peak position of Al therefrom on the surface layer side when subjected to glow discharge spectral analysis (GDS analysis).
3) An oxide film satisfying the characteristics in 1) can be obtained by the following procedure: an annealing facility is used in which the decarburization annealing furnace is provided, near the entry side thereof, with an exhaust vent for exhausting the atmosphere of the rapid heating chamber and that of the decarburization annealing furnace; the $PH_2O/PH_2$ ratio is held at 0.20 to 3.0 in the rapid heating chamber; the $PH_2O/PH_2$ ratio is held at 0.25 to 0.6 in the decarburization annealing furnace; and the residence time of the steel strip at temperatures of at least 7500° C. is held within 5 sec in the rapid heating chamber.
4) An oxide film satisfying the characteristics in 2) can be obtained by the following procedure: an annealing facility is used in which the decarburization annealing furnace is provided, near the entry side thereof, with an exhaust vent for exhausting the atmosphere of the rapid heating chamber and that of the decarburization annealing furnace; the $PH_2O/PH_2$ ratio is held at 0.8 to 1.8. in the rapid heating chamber; the $PH_2O/PH_2$ ratio is held at 0.25 to 0.6 in the decarburization annealing furnace; and the residence time of the steel strip at temperatures of at least 750° C. is held within 5 sec in the rapid heating chamber.

The present invention is based on the discoveries, and the features of the invention are as described below.

(1) A grain-oriented electrical steel sheet which has excellent film characteristics and magnetic characteristics,
comprising up to 0.005% of C, 2.0 to 7.0% of Si in terms of weight % and the balance Fe and unavoidable impurities,
having an oxide film which mainly contains forsterite and is formed on the surface, and an insulating coating formed on the oxide film,
wherein the amount of the oxide film is from 1 to 4 $g/m^2$ per side, and the depth of the peak position of Si from the oxide film surface is up to 1/10 of the depth of that of Al therefrom, (in glow discharge spectral analysis, GDS analysis, from the oxide film surface) and
showing a ratio y (%) with which peeling of the oxide film does not take place when subjected to a bending test with a curvature of 20 mm and which satisfies the following formula (1):

$$y(\%) \geqq -122.45t+112.55 \quad (1)$$

wherein t represents a sheet thickness in terms of mm,
and iron loss characteristics W (W/kg) which satisfy the following formula (2):

$$W(W/\mathrm{kg}) \leqq 2.37t+0.280 \quad (2)$$

wherein t represents a sheet thickness in terms of mm.

(2) The grain-oriented electrical steel sheet which has excellent film characteristics and magnetic characteristics as disclosed in (1), wherein the depth of the peak position of Si from the oxide film surface is up to 1/20 of the depth of that of Al therefrom, and the electrical steel sheet shows a ratio y (%) with which peeling of the oxide film does not take place when subjected to a bending test with a curvature of 20 mm and which satisfies the following formula (3):

$$y(\%) \geqq -122.45t+112.55 \quad (3)$$

wherein t represents a sheet thickness in terms of mm, and iron loss characteristics W (W/kg) which satisfy the following formula (4):

$$W(W/\mathrm{kg}) \leqq 2.37t+0.260 \quad (4)$$

wherein t represents a sheet thickness in terms of mm.

(3) In a process for producing a grain-oriented electrical steel sheet comprising the step of conventionally treating a slab comprising up to 0.10% of C, 2.0 to 7.0% of Si in terms of weight %, up to 400 ppm of Al, a conventional inhibitor component, and the balance Fe and unavoidable impurities and rolling to form a steel strip having a final product thickness, the step of decarburization annealing the steel strip, the step of final finishing annealing the steel strip and the step of conducting an insulating coating treatment, a process for producing a grain-oriented electrical steel sheet which has excellent film characteristics and magnetic characteristics as disclosed in (1), characterized in that:
the steel strip is rapidly heated to temperatures of at least 800° C. at a rate of at least 100° C./sec by subjecting the steel strip to a heating stage in the decarburization annealing step in a rapid heating chamber which is connectively provided to a decarburization annealing furnace while the $PH_2O/PH_2$ ratio is held at 0.20 to 3.0 and the residence time of the steel strip at temperatures of at least 750° C. is set within 10 sec in the rapid heating chamber; and
the steel strip is decarburization annealed in a decarburization annealing furnace provided with an exhaust vent near the entry side which exhausts the atmosphere of the rapid heating chamber and that of the decarburization annealing furnace, while the $PH_2O/PH_2$ ratio is held at 0.25 to 0.6 in the decarburization annealing furnace.

(4) In a process for producing a grain-oriented electrical steel sheet comprising the step of conventionally treating a slab comprising up to 0.10% of, C, 2.0 to 7.0% of Si in terms of weight %, up to 400 ppm of Al, a conventional inhibitor component, and the balance Fe and unavoidable impurities and rolling to form a steel strip having a final product thickness, the step of decarburization annealing the steel strip, the step of final finish annealing the steel strip and the step of conducting an insulating coating treatment, a process for producing a grain-oriented electrical steel sheet which has excellent film characteristics and magnetic characteristics as disclosed in (2), characterized in that:

the steel strip is rapidly heated to temperatures of at least 800° C. at a rate of at least 100° C./sec by subjecting the steel strip to a heating stage in the decarburization annealing step in a rapid heating chamber which is connectively provided to a decarburization annealing furnace while the $PH_2O/PH_2$ ratio is held at 0.8 to 1.8 and the residence time of the steel strip at temperatures of at least 750° C. is set within 5 sec in the rapid heating chamber; and the steel strip is decarburization annealed in a decarburization annealing furnace provided with an exhaust vent near the entry side which exhausts the atmosphere of the rapid heating chamber and that of the decarburization annealing furnace, while the $PH_2O/PH_2$ ratio is held at 0.25 to 0.6 in the decarburization annealing furnace.

(5) In a process for producing a grain-oriented electrical steel sheet comprising the step of conventionally treating a slab comprising up to 0.10% of C, 2.0 to 7.0% of Si in terms of weight %, up to 400 ppm of Al, a conventional inhibitor component, and the balance Fe and unavoidable impurities and rolling to form a steel strip having a final product thickness, the step of decarburization annealing the steel strip, the step of final finishing annealing the steel strip and the step of conducting an insulating coating treatment, a process for producing a grain-oriented magnetic steel sheet which has excellent film characteristics and magnetic characteristics as disclosed in (1), characterized by that:

the steel strip is rapidly heated to temperatures of at least 800° C. at a rate of at least 100° C./sec by subjecting the steel strip to a heating stage in the decarburization annealing step in a rapid heating chamber which is connectively provided to a decarburization annealing furnace through a throat portion, while the $PH_2O/PH_2$ ratio is held at 0.20 to 3.0 and the residence time of the steel strip at temperatures of at least 750° C. is set within 10 sec in the rapid heating chamber and throat portion; and the steel strip is decarburization annealed in a decarburization annealing furnace provided with an exhaust vent near the entry side which exhausts the atmosphere of the rapid heating chamber and that of the decarburization annealing furnace, while the $PH_2O/PH_2$ ratio is held at 0.25 to 0.6 in the decarburization annealing furnace.

(6) In a process for producing a grain-oriented electrical steel sheet comprising the step of conventionally treating a slab comprising up to 0.10% of C, 2.0 to 7.0% of Si in terms of weight %, up to 400 ppm of Al, a conventional inhibitor component, and the balance Fe and unavoidable impurities and rolling to form a steel strip having a final product thickness, the step of decarburization annealing the steel strip, the step of final finish annealing the steel strip and the step of conducting an insulating film treatment, a process for producing a grain-oriented electrical steel sheet having excellent film characteristics and magnetic characteristics as disclosed in (2), characterized in that:

the steel strip is rapidly heated to temperatures of at least 800° C. at a rate of at least 100° C./sec by subjecting the steel strip to a heating stage in the decarburization annealing step in a rapid heating chamber which is connectively provided to a decarburization annealing furnace through a throat portion, the $PH_2O/PH_2$ ratio in the rapid heating chamber and the throat portion being held at 0.8 to 1.8, while the residence time of the steel strip at temperatures of at least 750° C. is set within 10 sec in the rapid heating chamber and throat portion; and the steel strip is decarburization annealed in a decarburization annealing furnace provided with an exhaust vent near the entry side which exhausts the atmosphere of the rapid heating chamber and that of the decarburization annealing furnace, while the $PH_2O/PH_2$ ratio is held at 0.25 to 0.6 in the decarburization furnace.

(7) The process for producing a grain-oriented electrical steel sheet having excellent film characteristics and magnetic characteristics as disclosed in (3) to (6), wherein the rapid heating is carried out by conducting heating through directly applying a current using conductor rolls.

(8) The process for producing a grain-oriented electrical steel sheet having excellent film characteristics and magnetic characteristics as disclosed in (3) to (7), wherein magnetic domain refinement treatment is conducted.

(9) A decarburization annealing system for a grain-oriented electrical steel sheet comprising a rapid heating chamber internally provided with a rapid heating apparatus which heats a steel strip having been rolled to have a final product thickness to temperatures of at least 800° C. at a rate of at least 100° C./sec, and a decarburization annealing furnace for conducting decarburization annealing which is connectively provided to the rapid heating chamber and which has, near the entry side of the furnace, an exhaust vent for exhausting the atmosphere of the rapid heating chamber and that of the decarburization annealing furnace.

(10) A decarburization annealing facility for a grain-oriented electrical steel sheet comprising a rapid heating chamber internally provided with a rapid heating apparatus which heats a steel strip having been rolled to have a final product thickness to temperatures of at least 800° C. at a rate of at least 100° C./sec, and a decarburization annealing furnace for conducting decarburization annealing which is connectively provided to the rapid heating chamber through a throat portion and which has, near the entry side of the furnace, an exhaust vent for exhausting the atmosphere of the rapid heating chamber and that of the decarburization annealing furnace.

(11) The decarburization annealing facility for a grain-oriented electrical steel sheet as disclosed in (9) or (10), wherein the apparatus for conducting rapid heating comprises two pairs of rolls arranged at a distance in the passing direction of the steel strip, and each pair of rolls holds the steel strip between them and consists of a pair of conductor rolls, or a pressure roll and a conductor roll.

(12) The decarburization annealing facility for a grain-oriented electrical steel sheet having extremely excellent magnetic characteristics, wherein the rapid heating apparatus comprises two pairs of conductor rolls with pinch rolls arranged therebetween, the pinch rolls are provided near the high temperature side conductor rolls, and the steel strip is heated in such a manner that the portion of the steel strip held by the pinch rolls between them has temperatures of up to 750° C. and/or a decrease in the temperature of the portion is up to 50° C.

(13) The decarburization annealing facility for a grain-oriented electrical steel sheet as disclosed in (9), (10), (11) or (12), wherein nozzles for blowing the atmosphere gas against the steel strip surface are provided in the rapid heating chamber.

The phrase "an oxide film which mainly contains forsterite and is formed on the surface" used in the present invention means "an oxide film which mainly contains forsterite and is formed by a reaction with an annealing separator mainly containing MgO and an oxide film which is formed during decarburization annealing at a temperature of more than 800° C. with a heating rate of more than 100° C./sec".

BRIEF DESCRIPTION OF THE DRAWINGS

FIG. 2(*b*) is a graph showing examples of a Si profile and an Al profile obtained by GDS analysis of a grain-oriented electrical steel sheet as disclosed in claim 1 subsequent to removing the insulating coating.

FIG. 2(*c*) is a graph showing examples of a Si profile and an Al profile obtained by GDS analysis of a grain-oriented electrical steel sheet as disclosed in claim 2 subsequent to removing the insulating coating.

BEST MODE FOR CARRYING OUT THE INVENTION

The present invention will be explained below in a detail.

Figure 1:
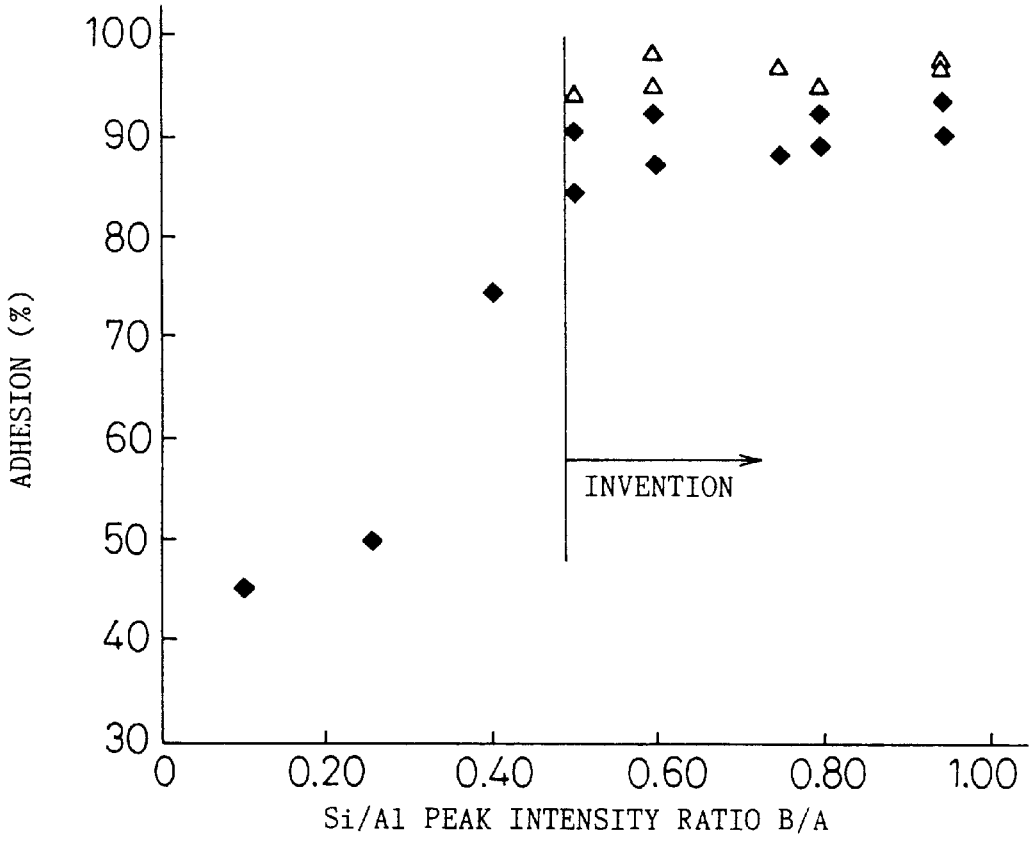
FIG. 1 is a graph showing Si and Al profiles obtained by GDS analysis, and a film adhesion of a grain-oriented electrical steel sheet.
Figure 2A:
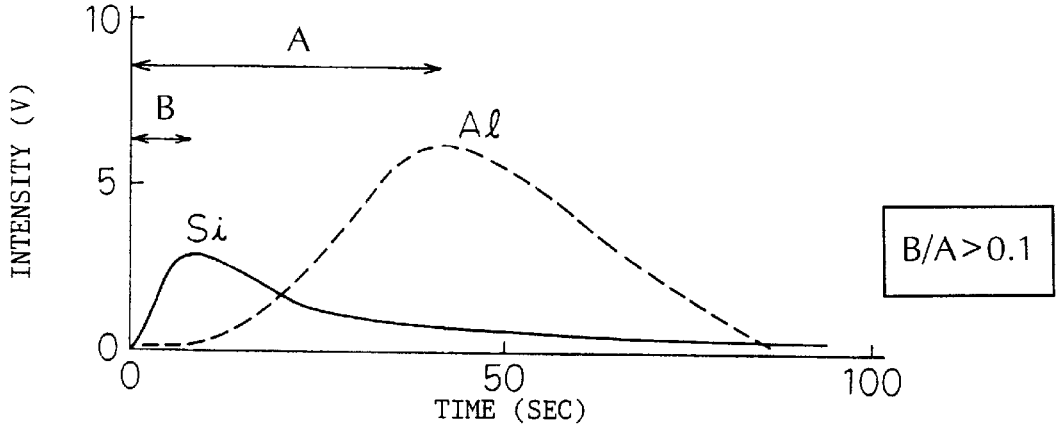
FIG. 2(*a*) is a graph showing examples of a Si profile and an Al profile obtained by GDS analysis of a conventional grain-oriented electrical steel sheet subsequent to removing the insulating coating.
Figure 2B:
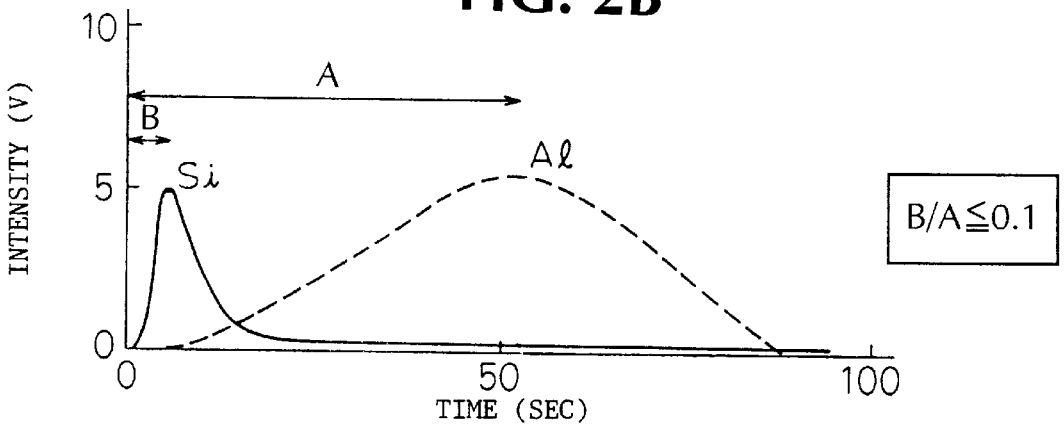
Figure 2C:
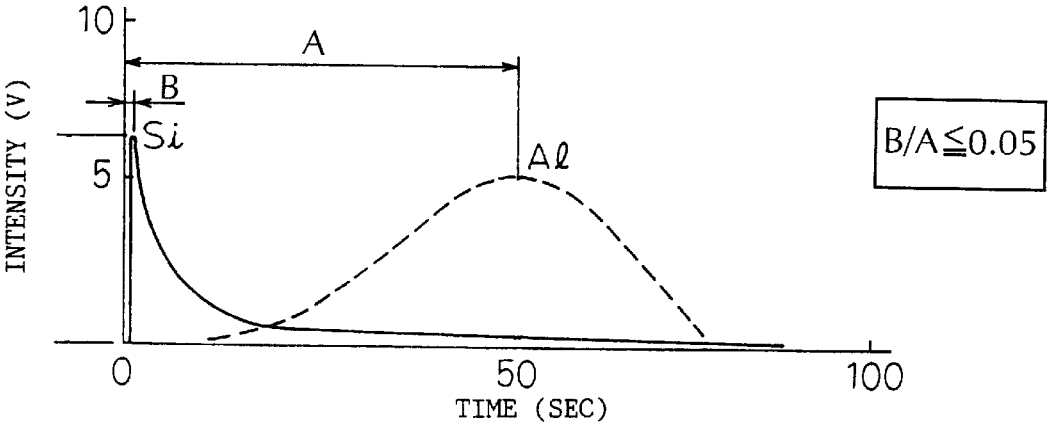

FIG. 2 shows the Si and Al profile obtained by glow discharge spectral analysis (GDS analysis) of a grain-oriented electrical steel sheet 0.23 mm thick from an oxide film surface, and a film adhesion of the steel, sheet. In addition, the results of the GDS analysis were obtained by removing the insulating coating from the final product to expose the oxide film, and applying the GDS analysis from the oxide film surface.

FIG. 2(*a*) shows the results of measuring GDS on a conventional product. FIG. 2(*b*), (*c*) shows the results of measuring GDS on steel sheets of the present invention. FIG. 2(*b*) shows the B/A ratio is less than 0.1. FIG. 2(*c*) shows the B/A ratio is less than 0.05.

Figure 3:
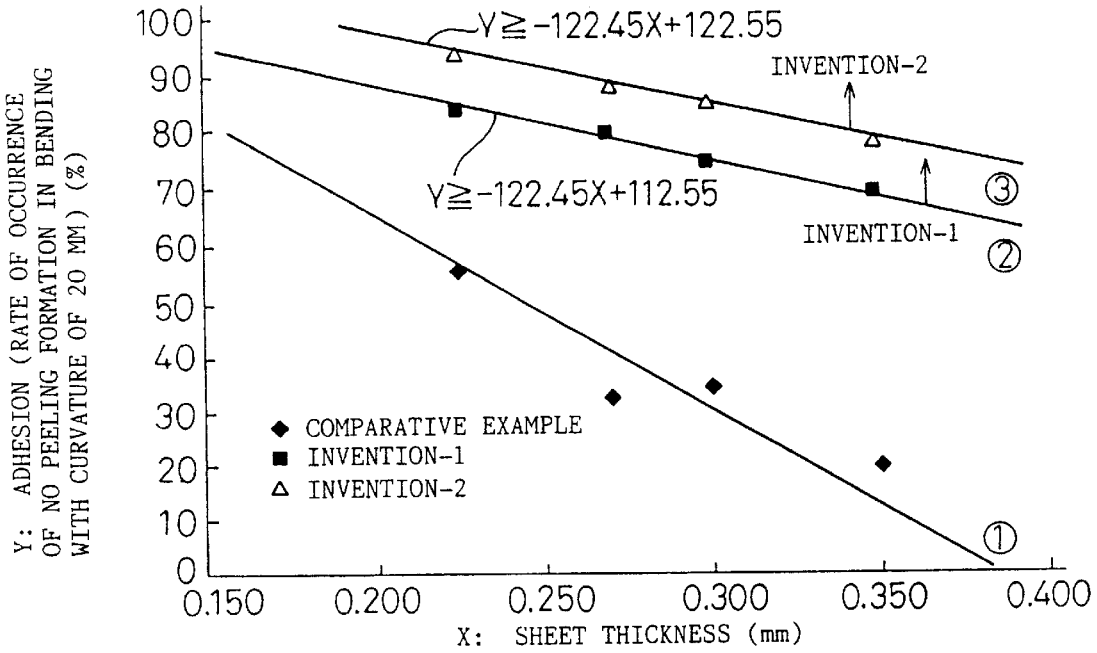
FIG. 3 is a graph showing the correlation between a sheet thickness and a film adhesion.

FIG. 3 shows the correlation between a sheet thickness of a steel sheet and a film adhesion characteristic. The adhesion of the film was evaluated from the proportion (%) in which peeling of the film took place when the steel sheet was bent with a curvature of 20 mm. The bending test was conducted as described below. About 6 bending test pieces were sampled from each of the about 130 product coils, and test pieces in a total number of about 800 were tested. In FIG. 3, ①, ② and ③ indicate the steel sheet showing that the GDS analysis pattern of FIG. 2(*a*), the one showing that of FIG. 2(*b*) and the one showing that of FIG. 2(*c*), respectively. According to the present invention, the grain-oriented electrical sheets show an improved film adhesion at any sheet thickness. Moreover, as shown in FIG. 2(*c*), a steel sheet having a B/A ratio of up to 0.05 demonstrates a further improved film adhesion.

The mechanism of improving the film adhesion as described above will be explained below:

Si and Al contained in the oxide films form oxides such as forsterite ($Mg_2SiO_4$) spinel ($MgAl_2O_4$) and cordierite ($Mg_2Al_4Si_5O_{16}$) in final finish annealing, and the oxides become the principal components of the oxide film formed on the steel sheet surface.

When the peak position of Si contained in the oxide film is close to the steel sheet surface, the principal components, as mentioned above, each tend to precipitate separately from others in a layer form in an oxide film subsequent to final finish annealing. Precipitation of each oxide in a layer form as described above allows crystallization of each oxide to proceed, and it is estimated that the adhesion of the film is consequently improved.

Conversely, when the peak position of Si is far from the steel sheet surface, the principal components of the oxide film are present in a mixture over the entire film. Consequently, it is estimated that crystallization of each oxide does not proceed, and that the film adhesion is not improved.

Figure 4:
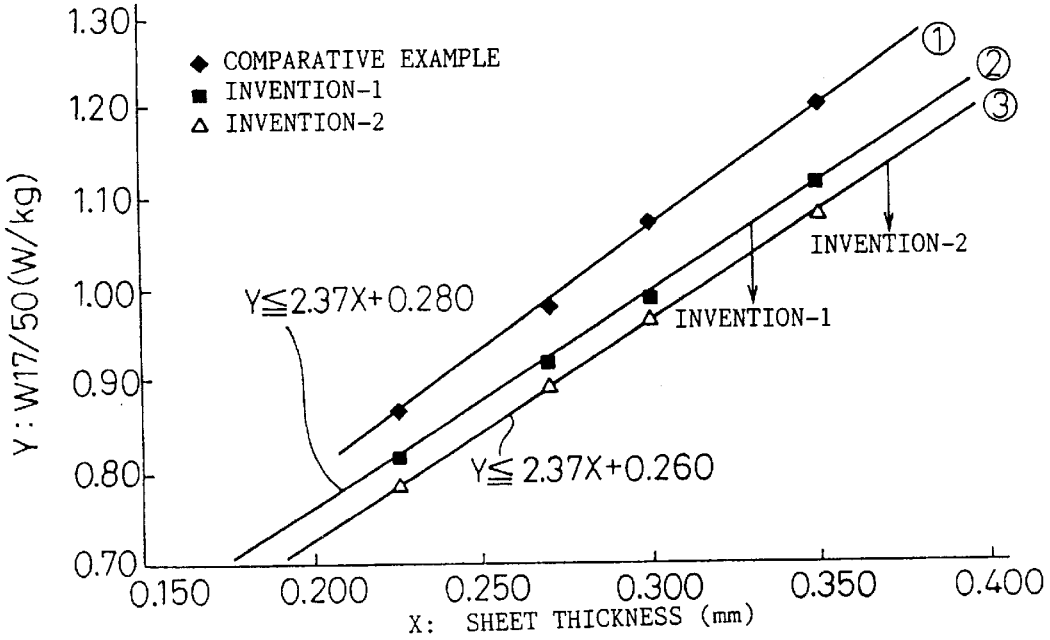
FIG. 4 is a graph showing the correlation between a sheet thickness and an iron loss.

FIG. 4 shows the correlation between a sheet thickness of a steel sheet and iron loss characteristics. In FIG. 4, ①, ② and ③ indicate the steel sheet showing that of the GDS analysis pattern of FIG. 2(*a*), the one showing that of FIG. 2(*b*) and the one showing that of FIG. 2(*c*), respectively. According to the present invention, the grain-oriented electrical steel sheets show an excellent iron loss at any sheet thickness. Moreover, as shown in FIG. 2(*c*), a steel sheet having a B/A ratio of up to 0.05 demonstrates a further improved iron loss.

Furthermore, the present inventors have discovered that the film excellent in adhesion can be obtained by controlling the initial oxide film formed in the decarburization annealing step. In general, principle metallurgy in the decarburization annealing step is formation of a primary recrystallization structure, formation of an oxide film and decarburization of the steel sheet. These treatments have conventionally been carried out within the same furnace.

In contrast to such a procedure, the present inventors have decided to use a decarburization annealing facility comprising a rapid heating chamber internally provided with a rapid heating apparatus which heats a steel strip having been rolled to have a final product thickness to temperatures of at least 800° C. at a rate of at least 100° C./sec, and a decarburization annealing which is connectively provided to the rapid heating chamber and which has, near the entry side of the furnace, an exhaust vent for exhausting the atmosphere of the rapid heating chamber and that of the decarburization annealing furnace. In the present invention, the oxide film growth, recrystallization and decarburization behavior in addition to the initial oxide film formation are controlled in the rapid heating chamber and decarburization annealing furnace while the function of the heating chamber and that of the furnace are separated. The mode of operation and effects will be concretely shown below.

The rapid heating chamber firstly aims at (1) formation of the initial oxide film and (2) generation of primary recrystallized nuclei. Formation of the initial oxide film greatly contributes to the film adhesion of the subsequent product. Formation of proper $SiO_2$ in the initial stage is important. The initial oxide layer refers to an oxide film having a thickness of the order of 100 Å on the extreme surface layer. The oxide film greatly contributes to the formation of an internal oxide layer of the order of several micrometers, and the film characteristics (adhesion). However, since formation of $SiO_2$ in an excessive amount sometimes hinders decarburization, delicate control of the formation of the initial oxide layer is required. In order to control the formation delicately, it is required to control the $PH_2O/PH_2$ ratio in the rapid heating chamber and the residence time at temperatures of at least 750° C. which are the initial oxide film formation temperatures of the steel strip therein.

Furthermore, for the formation of the recrystallized nuclei, the primary recrystallized texture such as (110) and (111) is controlled by the control of the heating rate and the cooling rate subsequent to reaching a heating temperature. When the heating rate becomes high, the texture (110) tends to increase, whereas the texture (111) tends to decrease. When the cooling rate subsequent to reaching a heating temperature becomes high, the texture (111) tends to increase, whereas the texture (100) tends to decrease. For example, when an induction heating apparatus is used as a rapid heating apparatus, the electrical steel sheet can be heated to at least 800° C. at a rate of at least 100° C./sec, preferably at least 300° C./sec by induction heating to increase the texture (110). Such rapid heating gives an excellent primary recrystallized texture. For example, when two pairs of conductor rolls are used, the steel strip is heated rapidly among rolls to temperatures of at least 800° C. at a rate of at least 100° C./sec, preferably at least 300° C./sec to increase the texture (110). Moreover, the steel strip can be cooled by 10 to 40° C. at a cooling rate of 2,000 to 30,000° C./sec to increase the texture (111) by extracting heat from the high temperature side rolls after reaching the heating temperature. A combination of such rapid heating and rapid cooling can give an optimum primary recrystallized texture.

The subsequent decarburization annealing furnace aims at (1) decarburization, (2) control of a primary recrystallized grain size and (3) control of an internal oxide film. The internal oxide film herein differs from the initial oxide layer mentioned above, and it refers to an oxide layer formed from the steel sheet surface toward the interior of the steel sheet to have a thickness of about a few micrometers. The oxide layer forms an oxide film composed of forsterite, etc. with MgO which is applied later.

The present inventors have found that the form of the internal oxide layer significantly varies depending on the form of the initial oxide film. Concretely, formation of $SiO_2$ in the extreme surface layer, of the order of angstroms, in the initial oxide layer increases the $SiO_2$ component in the subsequent internal oxide layer, greatly influences the structure of the forsterite film, and improves the film adhesion. Moreover, control of the primary recrystallized grain size controls the secondary recrystallization starting temperature. Consequently, the secondary recrystallized grain size is controlled, and the core loss is improved.

Accordingly, for the purpose of controlling the initial oxide film and the internal oxide layer as described above in the present invention, the atmospheres of the rapid heating chamber and decarburization annealing furnace are controlled, and the residence time of the steel strip at temperatures of at least 750° C. in the rapid heating chamber is controlled.

Figure 5:
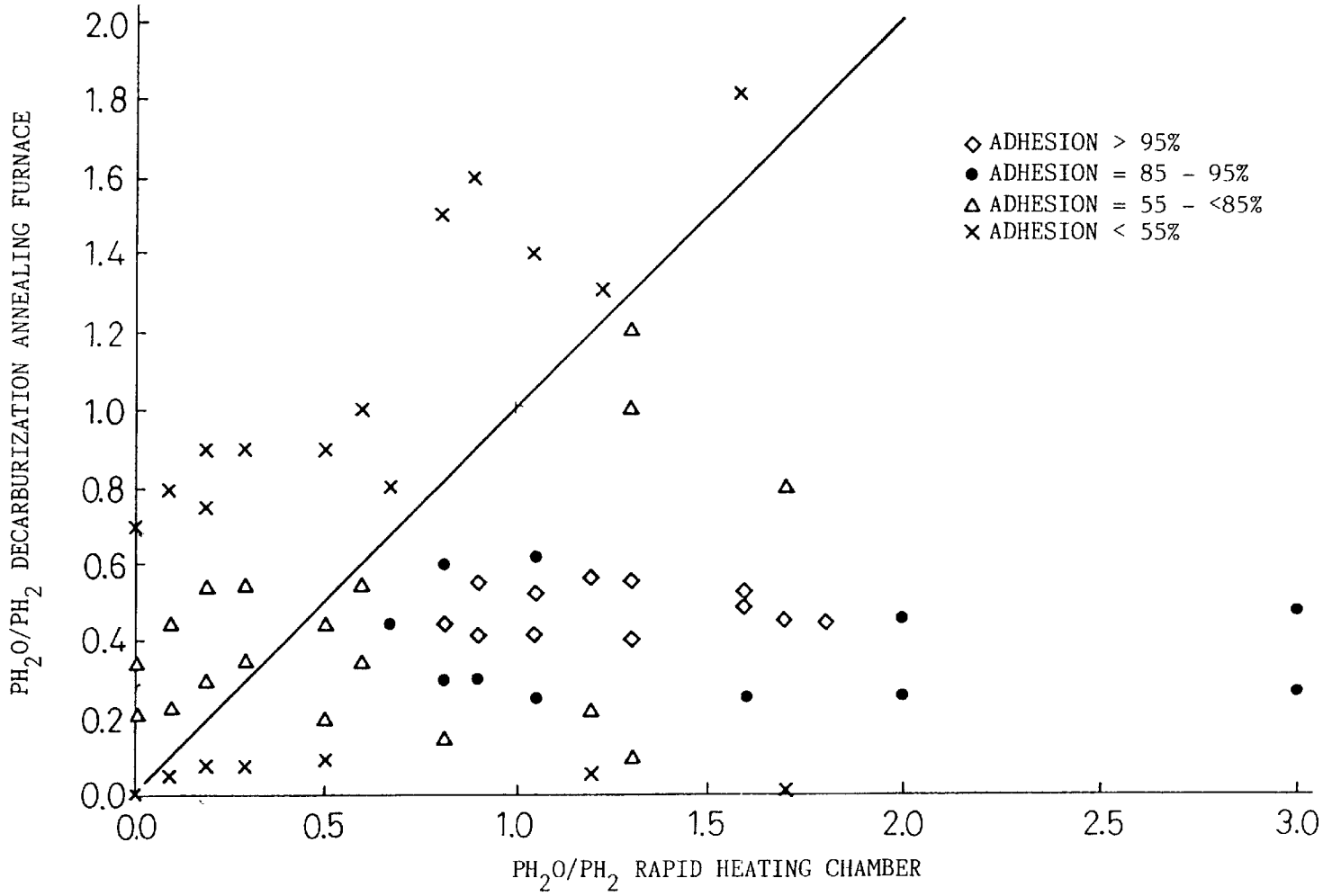
FIG. 5 is a graph showing the correlation among a $PH_2O/PH_2$ ratio in a rapid heating chamber, a $PH_2O/PH_2$ ratio in a decarburization annealing furnace and a film adhesion.

During the production of a grain-oriented electrical steel sheet having a thickness of 0.23 mm, the decarburization annealing facility explained above was used. FIG. 5 shows the relationship between film characteristics of the product and an atmosphere of the decarburization annealing facility when the $PH_2O/PH_2$ ratio in the rapid heating chamber and the $PH_2O/PH_2$ ratio in the decarburization annealing furnace were varied and the other conditions were set at the production conditions of the present invention.

In order to obtain an excellent film adhesion, the $PH_2O/PH_2$ ratio in the rapid heating chamber must be from 0.20 to 3.00. When the $PH_2O/PH_2$ ratio in the rapid heating chamber is less than 0.20, control of the initial oxide film becomes difficult, and a dense $SiO_2$ component becomes excessive in the surface layer. As a result, insufficient decarburization takes place in the subsequent decarburization annealing. Accordingly, the $PH_2O/PH_2$ ratio is defined to be at least 0.20. Moreover, when the $PH_2O/PH_2$ ratio exceeds 3.00 in the rapid heating chamber, the ratio of the Fe component oxide in the initial oxide film becomes excessive, and the electrical steel sheet shows a deteriorated film adhesion and deteriorated film characteristics. Accordingly, the ratio is defined to be up to 3.00.

Figure 6:
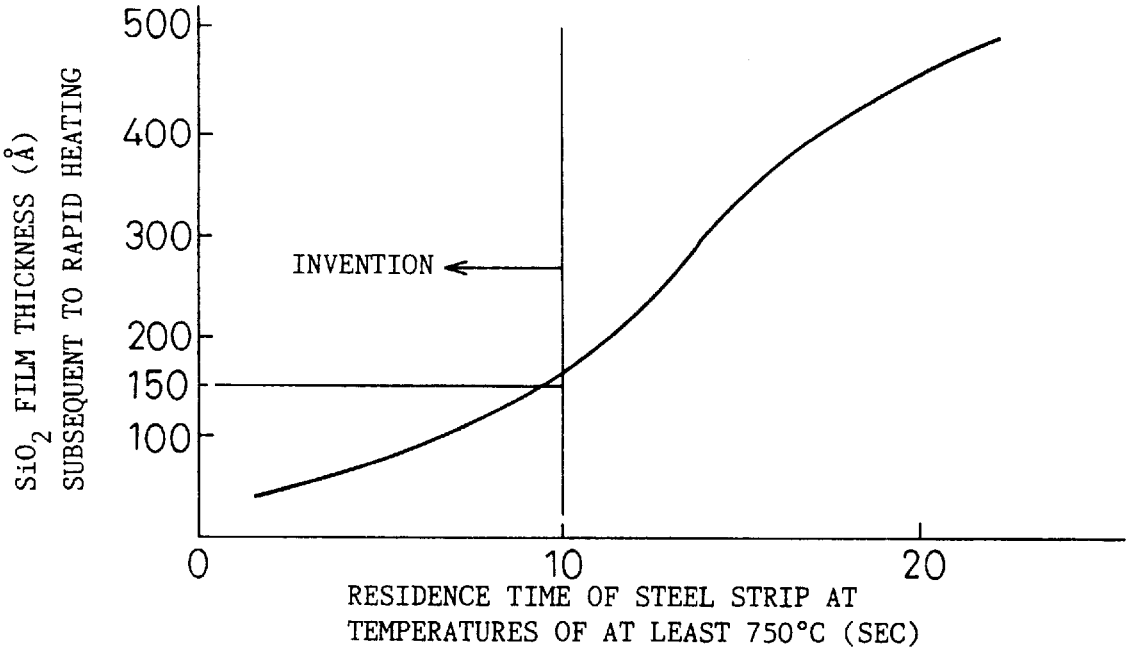
FIG. 6 is a graph showing the relationship between a residence time of a steel strip in a rapid heating chamber at temperatures of at least 750° C. and a thickness of an initial oxide film thus formed.

Furthermore, as to the formation of the initial oxide film, an excessively long residence time of the steel strip at temperatures of at least 750° C. in the rapid heating chamber having a $PH_2O/PH_2$ ratio as mentioned above exerts adverse effects on the decarburization performance, etc. A residence time range of a certain extent is, therefore, desirable. FIG. 6 is a graph showing the relationship between a residence time of a steel strip at temperatures of at least 750° C. in the rapid heating chamber and a thickness of the initial oxide film thus formed. It is seen from FIG. 7 that the $SiO_2$ film thickness exceeds 150 Å when the residence time of the steel strip at temperatures of at least 750° C. exceeds 5 sec. As a result, the decarburization rate is unpreferably determined at the interface. Accordingly, the residence time is defined to be up to 5 sec.

Furthermore, in order to obtain excellent film characteristics and an excellent decarburization performance, the $PH_2O/PH_2$ ratio in the decarburization annealing furnace must be from 0.25 to 0.6. When the $PH_2O/PH_2$ ratio is less than 0.25, decarburization of the steel sheet does not take place, and the thickness of the internal oxide layer becomes very small. As a result, subsequent formation of forsterite becomes improper. Accordingly, the $PH_2O/PH_2$ ratio is defined to be at least 0.25. Moreover, when the PH2O/FH2 ratio exceeds 0.6 in the decarburization annealing furnace, the Fe oxide in the internal oxide layer becomes excessive, and the effects of $SiO_2$ having been formed in the initial oxide film is lost, resulting in the formation of film defects, etc. Accordingly, the $PH_2O/PH_2$ ratio is defined to be up to 0.6.

As described above, a grain-oriented electrical steel sheet having excellent film characteristics and magnetic characteristics can be produced by setting the $PH_2O/PH_2$ ratio in the rapid heating chamber and the decarburization annealing furnace and the residence time of the steel strip having temperatures of at least 750° C. in the rapid heating chamber in given ranges. When the grain-oriented electrical steel sheet thus produced is subjected to GDS analysis from the oxide film surface, the depth from the oxide film surface to the Si peak position becomes up to 1/10 of the depth therefrom to the Al peak position.

Furthermore, when the $PH_2O/PH_2$ ratio in the rapid heating chamber is restricted to a narrower range of 0.8 to 1.8, a more proper initial oxide film mainly containing $SiO_2$ can be formed, and the film adhesion can be made excellent. When the $PH_2O/PH_2$ ratio in the rapid heating chamber is held in the range of 0.8 to 1.8, the proportion of the Si oxide to the Fe oxide becomes optimum, and the Si peak position in the primary film to be formed later is adjusted to locate in the surface layer, resulting in making the film characteristics more excellent.

The grain-oriented electrical steel sheet thus produced has further excellent film characteristics and magnetic characteristics. GDS analysis thereof from the oxide film surface shows that depth from the oxide film surface to the Si peak position is up to 1/20 of the depth of the Al peak position.

As explained above, the decarburization, formation of the initial oxide film and the internal oxide film and the primary recrystallization proceed approximately at the same time in the prior art. However, in the present invention, the function of the rapid heating chamber and that of the decarburization annealing chamber are separated. Consequently, a grain-oriented electrical steel sheet having excellent film characteristics and magnetic characteristics can be produced.

For example, an induction heating apparatus, a heating apparatus by directly applying current comprising two pairs of conductor rolls, and the like can be used as a rapid heating apparatus in the present invention. However, employment of the heating apparatus by directly applying current is preferred because the effects of improving primary recrystallized texture by rapid cooling can be obtained in addition to the effects of improving primary recrystallized texture by rapid heating as explained above. Concretely, the rapid heating apparatus is preferred to have two pairs of conductor rolls having pinch rolls arranged therebetween, and the pinch rolls are arranged near the high temperature side conductor rolls. The steel strip is heated in such a manner, by the apparatus, that the portion of the steel strip held by the pinch rolls between them has temperatures of up to 750° C. and/or a decrease in the temperature of the portion is up to 50° C.

The facility in which the rapid heating chamber and the decarburization annealing furnace are connected without using a throat is useful as a dedicated system used in the production process of the present invention. In the facility in which the rapid heating chamber and the decarburization annealing furnace are connected using a throat portion, the throat portion can be made to have a structure openable to the air. Therefore, when the throat portion is opened to the air, the inflow of the atmosphere of the decarburization annealing furnace into the rapid heating chamber internally provided with the rapid heating apparatus can be completely prevented. Accordingly, the rapid heating apparatus of the rapid heating chamber can be maintained, checked and repaired, while the decarburization annealing facility is being used as a facility for a conventional steel strip.

The initial oxide film is efficiently formed with a small amount of the atmosphere gas by blowing the atmosphere gas against the surface of the steel strip at temperatures of at least 750° C. between the conductor rolls. Nozzles for blowing the atmosphere gas against the steel strip surface should therefore be provided. The nozzles are each preferred to blow the gas from a position up to 1 m away from the strip surface in view of the consumption efficiency of the gas.

First, the grain-oriented electrical steel sheet of the present invention will be explained.

The grain-oriented electrical steel sheet of the present invention comprises up to 0.005% of C and 2.5 to 7.0% of Si in terms of weight %.

The C content is defined to be up to 0.005% because the properties are deteriorated due to the magnetic aging when the C content is at least this value.

The Si content is defined to be at least 2.0% to improve the iron loss. However, the Si content is defined to be up to 7.0% because the electrical steel sheet tends to form cracks during cold rolling and becomes difficult to work when the gi content is excessive. Accordingly, the Si content is defined to be up to 7.0%.

Furthermore, the grain-oriented electrical steel sheet of the present invention has an oxide film mainly containing forsterite on the surface. The film amount is from 1 to 4 $g/m^2$ per side. When the film amount of the oxide film exceeds 4 $g/m^2$, the space factor is lowered. Accordingly, the film amount is defined to be 4 $g/m^2$. On the other hand, when the amount of the oxide film is less than 1 $g/m^2$, a necessary film tension cannot be obtained. Accordingly, the film amount is defined to be at least 1 $g/m^2$.

Moreover, the depth from the oxide film surface to the Si peak position obtained by the GDS analysis is defined to be up to 1/10 of the depth from the oxide film surface to the Al peak position because a necessary primary film adhesion cannot be obtained when the depth of the Si peak position exceeds 1/10 of the depth mentioned above.

In addition, the GDS analysis in the present invention refers to the results obtained by removing the insulating coating from the final product to expose the oxide film, and applying GDS analysis from the oxide film surface. Moreover, the depth from the oxide film surface to the Si (Al) peak position obtained by GDS analysis is substantially judged from time from starting the analysis from the oxide film surface to the appearance of the peak.

A grain-oriented electrical steel sheet having the construction as explained above can show a rate of occurrence of no film peeling (adhesion) in bending the surface film around a curvature of 20 mm in the following region:

adhesion y (%)$\geqq -122.45$ t+122.55 (t: thickness in terms of mm). Moreover, the electrical steel sheet can attain excellent iron loss characteristics in the following region:

iron loss characteristics W (W/kg)$\leqq$2.37 t+0.280.

Furthermore, the grain-oriented electrical steel sheet in which the depth from the oxide film surface to the Si peak position obtained by GDS analysis is up to 1/20 of the depth therefrom to the Al peak position shows still more excellent film characteristics and magnetic characteristics. That is, the grain-oriented electrical steel sheet having the construction as mentioned above can show the rate of occurrence of no film peeling (adhesion) in bending the surface film around a curvature of 20 mm in the following region:

adhesion y (%)$\geqq -122.45$ t+122.55 (t: thickness in terms of mm).

Moreover, the electrical steel sheet can attain excellent iron loss characteristics in the following region:

Next, the process for producing a grain-oriented electrical steel sheet of the present invention will be explained.

In the process for producing a grain-oriented electrical steel sheet of the present invention, a slab comprising up to 0.10% of C, 2.0 to 7.0% of Si in terms of weight %, up to 400 ppm of Al, a conventional inhibitor component, and the balance Fe and unavoidable impurities is used as a starting material.

Since the decarburization time becomes long and the production becomes economically disadvantageous when the C content exceeds 0.10%, the C content is defined to be up to 0.10%.

The Si content is defined to be at least 2.0% for the purpose of improving the iron loss. When the Si content becomes excessive, the electrical steel sheet tends to form cracks during rolling, and deformation of the steel sheet becomes difficult. Accordingly, the Si content is defined to be up to 7.0%.

In order to use AlN as an inhibitor, acid-soluble Al is added. In order to obtain a proper dispersion state of AlN, the amount of acid-soluble AlN is defined to be up to 400 ppm. The amount is defined as mentioned above because a necessary dispersion state of AlN cannot be obtained when the amount of acid-soluble AlN is less than 400 ppm. Although there is no specific limitation on the N content in the present invention, addition of N in an amount of 0.003 to 0.02% is preferred in order to obtain proper AlN.

Furthermore, in the production of a grain-oriented electrical steel sheet, it is preferred to add component elements mentioned below as conventional inhibitor components.

When MnS is to be used as an inhibitor, Mn and S are added. Mn is an element necessary for forming MnS and (Mn·Fe)S, and is preferred to be added in an amount of 0.001 to 0.05% to obtain a suitable dispersed state. In addition, Se may be used in place of S, or S and Se may also be added.

Furthermore, at least one of inhibitor-forming elements such as Cu, Sn, Sb, Cr, Bi and Mo may be added to make the inhibitor effective, so long as the addition amount is up to 1.0%.

A cast steel slab is obtained by continuous casting a molten steel containing the components as mentioned above. The steel slab is hot rolled to give a steel strip having an intermediate thickness. A hot rolled steel sheet may also be obtained by a strip caster, and the like. The hot rolled steel strip is then subjected to hot rolled steel sheet annealing. The steel strip is then cold rolled once or at least twice with process annealing to give a steel strip having a final product thickness. Alternately, the hot rolled steel strip is cold rolled once or at least twice with process annealing without subjecting to hot rolled steel sheet annealing to give a steel strip having a final product thickness.

During rolling the steel strip twice with process annealing, the steel strip is firstly rolled with a reduction of 5 to 60%, annealing the hot rolled steel sheet and the process annealing are preferably conducted at temperatures of 950 to 1,200° C. for 30 sec to 30 minutes. The subsequent final reduction is desirably at least 85% because Goss nuclei in which the {110}<001> orientation has a high density in the rolling direction cannot be obtained when the final reduction is less than 85%.

In addition, during cold rolling mentioned above, the steel sheet is subjected to a plurality of passes through various thicknesses until it has a final thickness. In an intermediate sheet thickness stage, a thermal effect of holding the steel sheet in a temperature range of at least at 100° C. for at least 30 sec may be imparted to the steel sheet.

The steel strip having been rolled to have a final product thickness as explained above is decarburization annealed. In the present invention, decarburization annealing is carried out by using a decarburization annealing facility for a grain-oriented electrical steel sheet comprising a rapid heating chamber internally provided with a rapid heating apparatus, and a decarburization annealing furnace for conducting decarburization annealing which is connectively provided to the rapid heating chamber and which has, near the entry side of the furnace, an exhaust vent for exhausting the atmosphere of the rapid heating chamber and that of the decarburization annealing furnace. The decarburization annealing system may also have the rapid heating chamber and the decarburization annealing furnace which are connected through a throat portion. In order to control the initial oxide film and the internal oxide layer, it is particularly important to control the atmosphere in both the rapid heating chamber and the decarburization annealing furnace.

In the present invention, therefore, the $PH_2O/PH_2$ ratio in the rapid heating furnace is controlled to control the initial oxide film, and the $PH_2O/PH_2$ ratio in the decarburization annealing furnace is controlled to make the internal oxide layer, to be produced later, proper. Firstly, in order to obtain a good film adhesion, the $PH_2O/PH_2$ ratio in the rapid heating chamber must be from 0.20 to 3.00. When the $PH_2O/PH_2$ ratio is less than 0.20, control of the initial oxide film becomes difficult, and a dense $SiO_2$ component becomes excessive in the surface layer. As a result, poor decarburization takes place in subsequent decarburization annealing. Accordingly, the $PH_2O/PH_2$ ratio is defined to be at least 0.20. Moreover, when the $PH_2O/PH_2$ ratio exceeds 3.00 in the rapid heating chamber, the ratio of the Fe component oxide in the initial oxide film becomes excessive, and the film adhesion is deteriorated, resulting in the deterioration of the film characteristics. Accordingly, the $PH_2O/PH_2$ ratio is defined to be up to 3.00.

Furthermore, in order to obtain good film characteristics and a good decarburization performance, the $PH_2O/PH_2$ ratio in the decarburization annealing furnace must be from 0.20 to 0.6. When the $PH_2O/PH_2$ ratio is less than 0.20, decarburization of the steel sheet does not take place, and the internal oxide layer becomes very thin, resulting in inappropriate subsequent formation of forsterite. Accordingly, the $PH_2O/PH_2$ ratio is defined to be at least 0.25. Moreover, when the $PH_2O/PH_2$ ratio exceeds 0.6 in the decarburization annealing furnace, the Fe oxide in the internal oxide layer becomes excessive, and the effects of $SiO_2$ formed in the initial oxide film disappear, resulting in formation of film defects. Accordingly, the $PH_2O/PH_2$ ratio is defined to be up to 0.6.

In addition, when the decarburization annealing system having the rapid heating chamber and the decarburization annealing furnace which are connected through a throat portion is used, the atmosphere of the throat portion is the same as that of the rapid heating chamber, and the same atmosphere control is conducted in the throat portion.

Furthermore, thin $SiO_2$ can be formed in the initial stage by setting the residence time of the steel strip at temperatures of at least 750° C. as short as up to 10 sec in the rapid heating chamber having a $PH_2O/PH_2$ ratio as mentioned above. Since the thickness of the $SiO_2$ layer exceeds 150 Å when the residence time of the steel strip at least at 750° C. exceeds 5 sec, the residence time is defined to be up to 5 sec.

As explained above, a grain-oriented electromagnetic steel sheet having excellent film characteristics and iron loss characteristics can be obtained by specifying the $PH_2O/PH_2$ ratio in the rapid heating chamber and the decarburization annealing furnace, and specifying the residence time of the steel strip in the rapid heating chamber having a $PH_2O/PH_2$ ratio defined above.

Glow discharge spectral analysis (GDS analysis) of the grain-oriented magnetic steel sheet obtained by they process as mentioned above, the depth of the Si peak position from the oxide film surface is up to 1/10 of the depth of the Al peak position therefrom. The electrical steel sheet is very excellent in film adhesion (at least 85%, with a sheet thickness of 0.23 mm).

Furthermore, in order to make the film adhesion (exceeding 95%, with a sheet thickness of 0.23 mm) more excellent, the $PH_2O/PH_2$ ratio in the rapid heating chamber should be held in the range of 0.8 to 1.8. A more proper initial oxide film mainly containing $SiO_2$ can be formed by controlling the atmosphere as explained above. That is, when the $PH_2O/PH_2$ ratio is in the range of 0.8 to 1.8, the proportion of Si oxides to Fe oxides becomes optimum, and the Si peak position in the primary film to be formed subsequently is controlled to locate in the surface layer, resulting in making the film adhesion more excellent.

Glow discharge spectral analysis (GDS analysis) of the grain-oriented magnetic steel sheet obtained by the process as mentioned above, the depth of the Si peak position from the oxide film surface is up to 1/20 of the depth of the Al peak position therefrom. The magnetic steel sheet is very excellent in film adhesion (exceeding 95%, with a sheet thickness of 0.23 mm).

The following procedure can be adopted to conduct rapid heating: two pairs of rolls, each pair holding the steel strip between them and consisting of a pair of conductor rolls, or a pressure roll and a conductor roll, are provided at a distance in the passing direction of the steel strip; the steel strip is heated to at least 800° C. by applying a current. Naturally, a noncontact induction heating procedure for a magnetic steel sheet may be adopted. The heating rate of a steel strip is defined to be at least 100° C./sec. The lower limit rate is defined to be 100° C./sec because {110}<001> oriented grains subsequent to recrystallization which are necessary for secondary recrystallization decrease if the heating rate lowers the lower limit value. The heating temperatures are defined to be at least 800° C. because nucleation of the primary recrystallization does not take place when the heating temperatures are less than 800° C.

In addition, cooling the rapidly heated steel sheet is preferably carried out at a high temperature zone in a conductor roll rapid heating process.

Figure 7:
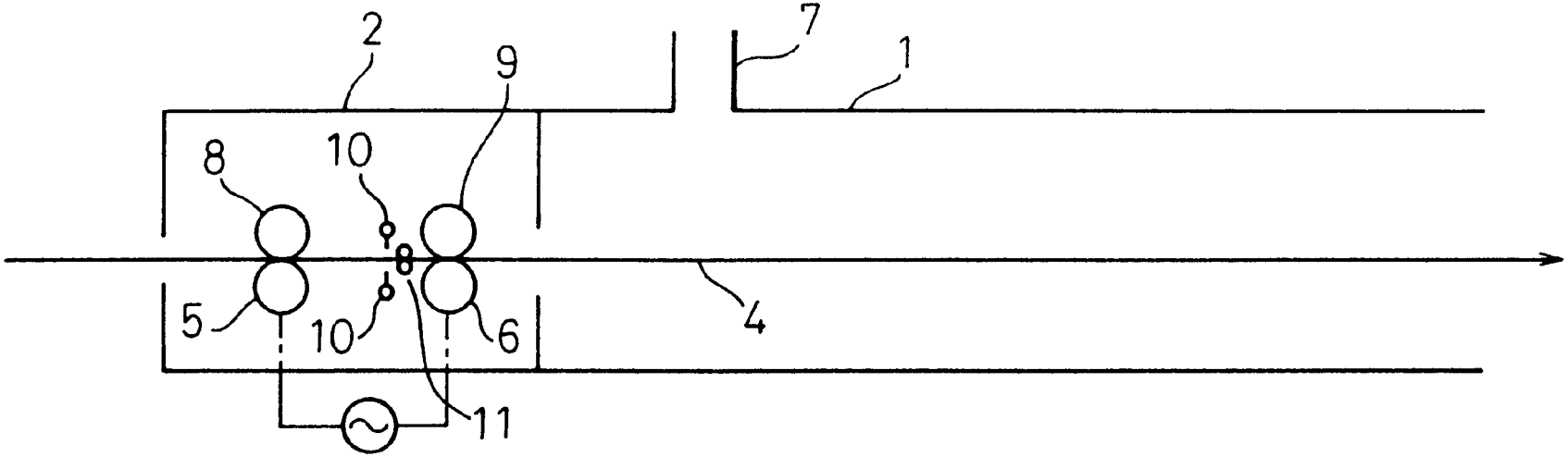
FIG. 7 is a schematic view showing one embodiment of a decarburization annealing facility of the present invention.

The decarburization annealing as explained above is conducted in a decarburization annealing facility which is shown in FIG. 7 and which comprises a rapid heating chamber 2 shown in FIG. 7 for conducting rapid heating in a heating stage and a decarburization annealing furnace 1 for conducting decarburization annealing connectively provided to the rapid heating chamber 2 and having, near the entry side of the decarburization annealing furnace 1, an exhaust vent 7 for exhausting the atmosphere of the rapid heating chamber 2 and that of the decarburization annealing furnace 1.

Furthermore, the decarburization annealing may also be conducted in a decarburization annealing system comprising a rapid heating chamber 2 for rapid heating in the heating stage, and a decarburization annealing furnace 1 for conducting decarburization annealing which is connectively provided to the rapid heating chamber 2 through a throat portion 3 and which has, near the entry side of the decarburization annealing furnace 1, an exhaust vent 7 for exhausting the atmosphere of the rapid heating chamber 2 and that of the decarburization annealing furnace 1.

Figure 8:
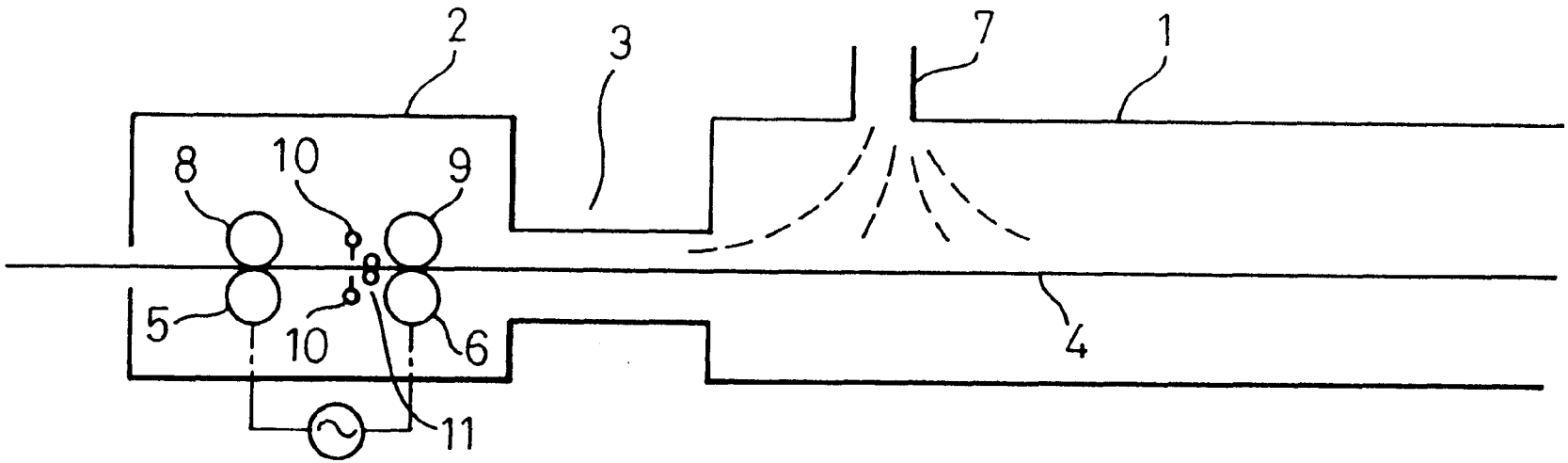
FIG. 8 is a schematic view showing one embodiment of a decarburization annealing facility of the present invention.

Reference numerals in FIGS. 7 and 8 designate parts as follows: 4: a steel strip; 5, 6: conductor rolls; 8, 9: pressure rolls which form pairs in combination with the conductor roll 5 and the conductor roll 6, respectively, each of the pairs holding a steel strip between the rolls; 10, 10: nozzles for blowing the atmosphere gas against the steel strip surface at temperatures of at least 750° C. being rapidly heated between the conductor rolls 5, 6; and 11, 11: pinch rolls holding the steel strip 4 between them. The gap between the steel strip and any one of the nozzles is up to 1 m.

In order not to deteriorate the magnetic characteristics of the product in the decarburization annealing step explained above, the carbon content must be decreased to up to 20 ppm. When a process is employed wherein the slab heating temperature in hot rolling is lowered, and AlN alone is used as an inhibitor, the steel strip may be nitrided in an ammonia atmosphere.

Furthermore, the steel strip is coated with an annealing separator, and finish annealed at temperatures of at least 1,100° C. for the purpose of performing secondary recrystallization and purification. As a result, a steel strip containing fine secondary recrystallized grains and having an excellent film such as forsterite formed on the surface are obtained.

A grain-oriented electrical steel sheet having an extremely low iron loss is produced by further coating the excellent film such as forsterite with an insulating coating. The insulating coating refers to a secondary coating used for a conventional grain-oriented electrical steel sheet and containing a phosphate and colloidal silica as the principal components. The magnetic characteristics mentioned above maintain a low iron loss which does not change even after carrying out stress relief annealing.

In addition, in order to improve the iron loss further in the product thus obtained, the grain-oriented electrical steel sheet may be subjected to fine magnetic domain refinement treatment.

EXAMPLES

Example 1-1

A molten steel containing, in terms of weight %, 3.25% of Si, 0.078% of C, 0.08% of Mn, 0.01% of P, 0.03% of S, 0.03% of Al, 0.09% of N, 0.08% of Cu and 0.1% of Sn was cast. The resultant slab was heated, and hot rolled to give a hot rolled steel sheet having a thickness of 2.3 mm. The steel sheet was then annealed at 1,1000° C. for 3 minutes, pickled, and cold rolled to give a steel sheet having a thickness of 0.22 mm. During rolling, the steel sheet was annealed at 220° C. for 5 minutes.

The steel sheets A and B thus rolled were decarburization annealed by a conventional procedure in wet hydrogen.

The rolled steel sheets C to J were passed through the decarburization annealing system, which is shown in FIG. 7 and will be explained below, at a rate of 60 m/min, under the conditions listed in Table 1. The steel sheets were then coated with MgO, high temperature annealed in a hydrogen atmosphere at 1,200° C. for 24 hours. The steel sheets were coated with an insulating coating in the subsequent finish annealing line to give products.

The decarburization annealing system is as follows: the system comprised (1) a rapid heating chamber 2 wherein a pair of rolls consisting of a conductor roll 5 and a pressure roll 8 and holding a steel strip 4 between them and a pair of rolls consisting of a conductor roll 6 and a pressure roll 9 and holding the steel strip 4 between them were arranged 1.7 m apart, atmosphere gas-blowing nozzles 10, 10 located in positions 0.5 m above the surface of the steel strip between the pairs of the rolls were provided 0.2 m apart from the point where the steel strip was held between the rolls 6 and 9 and (2) a decarburization annealing furnace 1; the rapid heating chamber 2 and the decarburization annealing furnace 1 were connected through a throat 3 having a length of 1.5 m; the decarburization annealing furnace 1 was provided with an exhaust vent 7 which was 1.6 m apart from the entry of the decarburization annealing furnace 1 and which was used for exhausting the atmospheres of the heating chamber 2 and the annealing furnace 1.

The coils C to G satisfying the conditions of the present invention were obtained as grain-oriented electrical steel sheets excellent in film characteristics and an iron loss. In particular, the coils C to E showed more excellent film characteristics and iron loss characteristics.

TABLE 2

| | Iron loss prior to magnetic domain control (W17/50, W/kg) | Iron loss subsequent to magnetic domain control (W17/50, W/kg) | Note |
|---|---|---|---|
| B | 0.92 | 0.84 | Conventional process |
| C | 0.76 | 0.69 | Process-2 of invention |
| F | 0.81 | 0.73 | Process-1 of invention |
| H | 0.85 | 0.77 | Comparative material |

TABLE 1

| | Rapid heating chamber | | | | Throat portion | | Decarburization annealing furnace | |
|---|---|---|---|---|---|---|---|---|
| Coil | Heating rate (° C./sec) | Temp. reached | Residence time (sec) | $PH_2O/PH_2$ | Residence time | $PH_2O/PH_2$ | Temp. (° C.) | $PH_2O/PH_2$ |
| A | — | — | — | — | — | — | 845 | 0.55 |
| B | — | — | — | — | — | — | 845 | 0.45 |
| C | 480 | 850 | 1.5 | 0.85 | 1.5 | 0.85 | 845 | 0.45 |
| D | 480 | 850 | 1.4 | 1.40 | 1.5 | 1.40 | 845 | 0.45 |
| E | 480 | 850 | 1.4 | 1.75 | 1.5 | 1.75 | 845 | 0.45 |
| F | 480 | 850 | 1.4 | 0.70 | 1.5 | 0.70 | 845 | 0.45 |
| G | 480 | 850 | 1.4 | 2.90 | 1.5 | 2.90 | 845 | 0.45 |
| H | 480 | 850 | 1.4 | 0.05 | 1.5 | 0.05 | 845 | 0.45 |
| I | 480 | 850 | 1.4 | 0.10 | 1.5 | 0.10 | 845 | 0.45 |
| J | 480 | 850 | 1.4 | 0.15 | 1.5 | 0.15 | 845 | 0.45 |

| | Product characteristics | | | | | | | |
|---|---|---|---|---|---|---|---|---|
| Coil | Si/Al P ratio# | Amt. of forsterite ($g/m^2$) | Adhesion | C (ppm) | Secondary recrystallized grain size | Iron loss value (W17/50) | Iron loss value after aging** W17/50 (W/kg) | Note*** |
| A | 0.50 | 5.0 | 20.0 | 11 | 10.5 | 0.95 | 0.95 | Conv |
| B | 0.30 | 3.0 | 45.0 | 13 | 8.9 | 0.92 | 0.92 | Conv |
| C | 0.03 | 2.0 | 99.0 | 18 | 3.2 | 0.76 | 0.76 | Inv-2 |
| D | 0.04 | 2.1 | 98.5 | 20 | 2.8 | 0.77 | 0.77 | Inv-2 |
| E | 0.01 | 2.5 | 99.8 | 19 | 3.3 | 0.75 | 0.75 | Inv-2 |
| F | 0.07 | 1.8 | 85.0 | 20 | 3.5 | 0.81 | 0.81 | Inv-1 |
| G | 0.09 | 2.0 | 90.0 | 21 | 3.1 | 0.80 | 0.80 | Inv-1 |
| H | 0.20 | 1.1 | 79.0 | 55 | 3.5 | 0.85 | 1.10 | Comp |
| I | 0.40 | 1.2 | 55.0 | 45 | 3.3 | 0.87 | 0.98 | Comp |
| J | 0.30 | 0.9 | 60.0 | 41 | 3.4 | 0.87 | 0.96 | Comp |

Note
Residence time is a time during which a steel strip was held at temperatures of at least 750° C.
**Aging: 250° C. × 200 hours
#Si/Al P ratio = ratio of the depth of the peak position of Si to that of the peak position of Al
***Conv = Conventional process, Inv-2 = Process-2 of the present invention, Inv-1 = Process 1 of the present invention Comp = Comparative material

Example 1-2

The four product coils B, C, F and H were further passed through a magnetic domain control production line, whereby grooves 15 $\mu$m deep and 90 $\mu$m wide were formed in the direction making an angle of 12 degrees with the direction (C-direction) transverse to the passing direction of the coils at intervals of 5 mm with a gear type roll. The coils were then coated with an insulating coating in an amount of 1 $g/m^2$ to give final products. Table 2 shows the magnetic characteristic values of each of the coils.

Example 2

A molten steel having the same chemical composition as in Example 1 was cast, and steel strips having a thickness of 0.22 mm were obtained by the same step as in Example 1. The steel strips were then subjected to the same process as in Example 1 using a decarburization annealing facility having the same construction as that in Example 1 except that the system had no throat portion. As a result, grain-oriented electrical steel sheets excellent in film characteristics and iron loss characteristics were obtained. In particular, grain-oriented electrical steel sheets having more excellent film characteristics and iron loss characteristics were obtained from those coils which satisfied all the conditions.

Possibility of Utilization in the Industry

The present invention can provide a grain-oriented electrical steel sheet excellent in film characteristics and extremely excellent in magnetic characteristics. The present invention can further provide a process and embodiments of a facility for producing the grain-oriented electrical steel sheet.

What is claimed is:

1. In a process for producing a grain-oriented electrical steel sheet comprising the step of conventionally treating a slab comprising up to 0.10% of C, 2.0 to 7.0% of Si in terms of weight %, up to 400 ppm of Al, a conventional inhibitor component, and the balance Fe and unavoidable impurities and rolling to form a steel strip having a final product thickness, the step of decarburization annealing the steel strip, the step of final finishing annealing the steel strip, and the step of conducting an insulating coating treatment, said process comprising:

the steel strip is rapidly heated to temperatures of at least 800° C. at a rate of at least 100° C./sec by subjecting the steel strip to a heating stage in the decarburization annealing step in a rapid heating chamber which is connectively provided to a decarburization annealing furnace through a throat portion while the $PH_2O/PH_2$ ratio is held at 0.20 to 3.0 and the residence time of the steel strip at temperatures of at least 750° C. is set less than 10 sec in the rapid heating chamber; and the steel strip is decarburization annealed in a decarburization annealing furnace provided with an exhaust vent near the entry side which exhausts the atmosphere of the rapid heating chamber and that of the decarburization annealing furnace, while the $PH_2O/PH_2$ ratio is held at 0.25 to 0.6 in the decarburization annealing furnace;

wherein the $PH_2O/PH_2$ ratio in the rapid heating chamber is more than the $PH_2O/PH_2$ ratio in the decarburization annealing furnace so as to provide improved oxide film adhesion.

2. In a process for producing a grain-oriented electrical steel sheet comprising the step of conventionally treating a slab comprising up to 0.10% of C, 2.0 to 7.0% of Si in terms of weight %, up to 400 ppm of Al, a conventional inhibitor component, and the balance Fe and unavoidable impurities and rolling to form a steel strip having a final product thickness, the step of decarburization annealing the steel strip, the step of final finish annealing the steel strip and the step of conducting an insulating coating treatment, said process comprising:

the steel strip is rapidly heated to temperatures of at least 800° C. at a rate of at least 100° C./sec by subjecting the steel strip to a heating stage in the decarburization annealing step in a rapid heating chamber which is connectively provided to a decarburization annealing furnace through a throat portion while the $PH_2O/PH_2$ ratio is held at 0.8 to 1.8 and the residence time of the steel strip at temperatures of at least 750° C. is set less than 10 sec in the rapid heating chamber and the throat portion; and the steel strip is decarburization annealed in a decarburization annealing furnace provided with an exhaust vent near the entry side which exhausts the atmosphere of the rapid heating chamber and that of the decarburization annealing furnace, while the $PH_2O/PH_2$ ratio is held at 0.25 to 0.6 in the decarburization annealing furnace.

3. A process for producing a grain-oriented electrical steel sheet according to claim 1 where the residence time of the steel strip at temperatures of at least 750° C. is set less than 10 sec in the rapid heating chamber and the throat portion.

4. The process for producing a grain-oriented electrical steel sheet according to claim 1, 2 or 3 wherein magnetic domain refinement is conducted.

5. A process for producing a grain-oriented electrical steel sheet according to claim 1, 2 or 3 further comprising:

carrying out said rapid heating by providing two pairs of rolls in said rapid heating chamber, spacing said two pair of rolls apart at a distance in a passing direction of the steel strip, each pair of rolls comprising a pressure roll and a conductor roll, with each pair of rolls holding the steel strip between them;

arranging pinch rolls between said two pairs of rolls, with the pinch rolls located near a high temperature side conductor roll;

said rapid heating taking place in a manner such that a portion of the steel strip held between the pinch rolls decreases in temperature not more than 50° C.

* * * * *